United States Patent [19]

Printz

[11] 4,139,412

[45] Feb. 13, 1979

[54] MULTI-PLY CONTINUOUS PAPER WEB FORMER

[75] Inventor: Warren G. Printz, Middletown, Ohio

[73] Assignee: Diamond International Corporation, New York, N.Y.

[21] Appl. No.: 792,750

[22] Filed: May 2, 1977

Related U.S. Application Data

[63] Continuation of Ser. No. 685,788, May 13, 1976, abandoned, which is a continuation of Ser. No. 547,005, Feb. 4, 1975, abandoned, which is a continuation of Ser. No. 73,056, Sep. 15, 1970, abandoned, which is a continuation of Ser. No. 725,829, May 1, 1968, abandoned.

[51] Int. Cl.[2] ..... D21F 1/60; D21F 3/10; D21F 9/04

[52] U.S. Cl. ..... 162/276; 162/304; 162/357; 162/370; 162/371

[58] Field of Search ..... 162/123, 133, 317, 321, 162/368, 298, 299, 300, 304, 370, 348, 274, 276, 357, 371

[56] References Cited

U.S. PATENT DOCUMENTS

| | | | |
|---|---|---|---|
| 1,881,914 | 10/1932 | Parker | 162/133 |
| 2,209,759 | 7/1940 | Berry | 162/276 X |
| 2,772,606 | 12/1956 | Kelly | 162/276 |
| 2,943,678 | 7/1960 | Fasoli | 162/370 X |
| 2,991,218 | 7/1961 | Cirrito et al. | 162/321 X |
| 3,902,960 | 9/1975 | Zentner et al. | 162/370 X |

FOREIGN PATENT DOCUMENTS

| | | | |
|---|---|---|---|
| 215070 | 10/1909 | Fed. Rep. of Germany | 162/299 |

*Primary Examiner*—Marc L. Caroff
*Attorney, Agent, or Firm*—Karl W. Flocks

[57] ABSTRACT

A foraminous multi-zone wire mesh covered suction roll useful in a papermaking machine and in a multi-cylinder paper-making machine wherein the roll is divided into at least four discrete zones by generally radial divider elements and wherein at least a first zone collects water, a second zone is in an area where transfer of the wet ply takes place to a continuous carrier, a third or transition zone carries excess water in the wire mesh away from the second zone to a fourth water release zone, and wherein the carrier is intimately associated with the roll and formed ply in an area subtended by the projection of the spaced divider elements defining the second or transfer zone so that the formed wet ply in this area is in contact with the wire mesh covering the suction roll on one side and in contact on its other side with the continuous carrier and so the formed wet ply in this area is between this wire mesh and the carrier. A couch roll is disposed beneath the center of the suction roll and engages the carrier to provide a pressure nip; with the center of the suction roll, a divider element associated with the second zone, and the center of the couch roll all being in radial alignment.

2 Claims, 2 Drawing Figures

MULTI-PLY CONTINUOUS PAPER WEB FORMER

Figure 1:
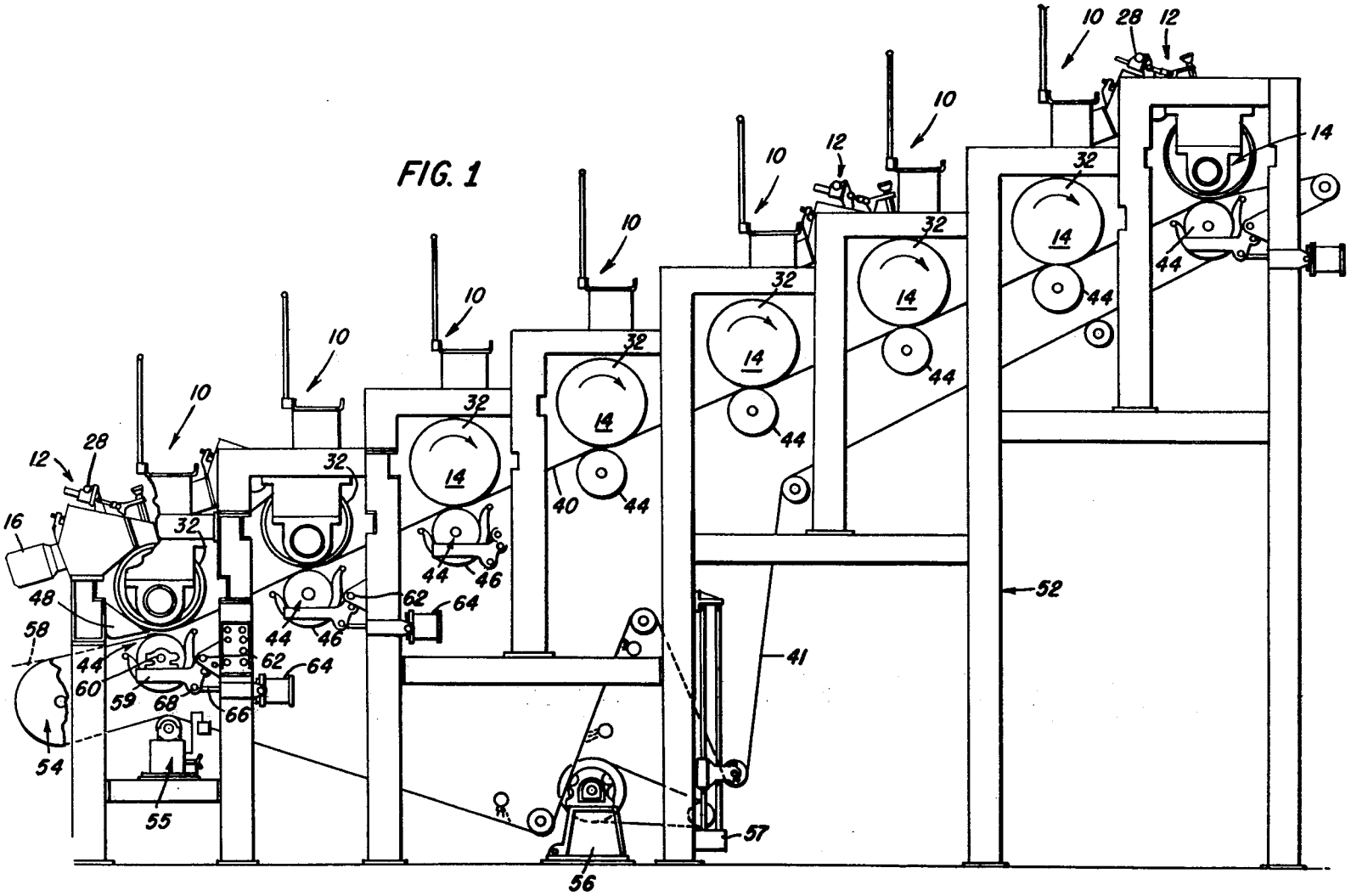

This application is a continuation of Ser. No. 685,788, filed May 13, 1976, now abandoned, which is a continuation of applicant's then copending application Ser. No. 547,005, filed Feb. 4, 1975, now abandoned without prejudice, which was a continuation of applicant's copending application Ser. No. 73,056, filed Sept. 15, 1970, now abandoned without prejudice, and which was a continuation of applicant's then copending basic parent application Ser. No. 725,829, filed May 1, 1968 now abandoned without prejudice.

There has been a constant demand for producing good quality, continuous webs of paper, paperboard, etc. at high rates of speed. A cylinder-type former occupies less space than a conventional fourdrinier type former and can produce continuous webs at a comparable rate of speed, if specifically designed for high speed application.

The primary objects of the present invention are to provide a novel method and apparatus whereby a high grade multi-ply, continuous web of paper or paperboard can be produced at a high rate of speed, to provide apparatus which occupies a minimum of horizontal space and in so doing permit the use of a transfer felt, wire or fabric in which the path of travel is substantially maintained in a single plane passing beneath each of a plurality of cylinders and affords improved drainage and rapid departure of a formed ply; and to provide a method and apparatus for producing high quality, multi-ply webs at a rapid rate.

Figure 2:
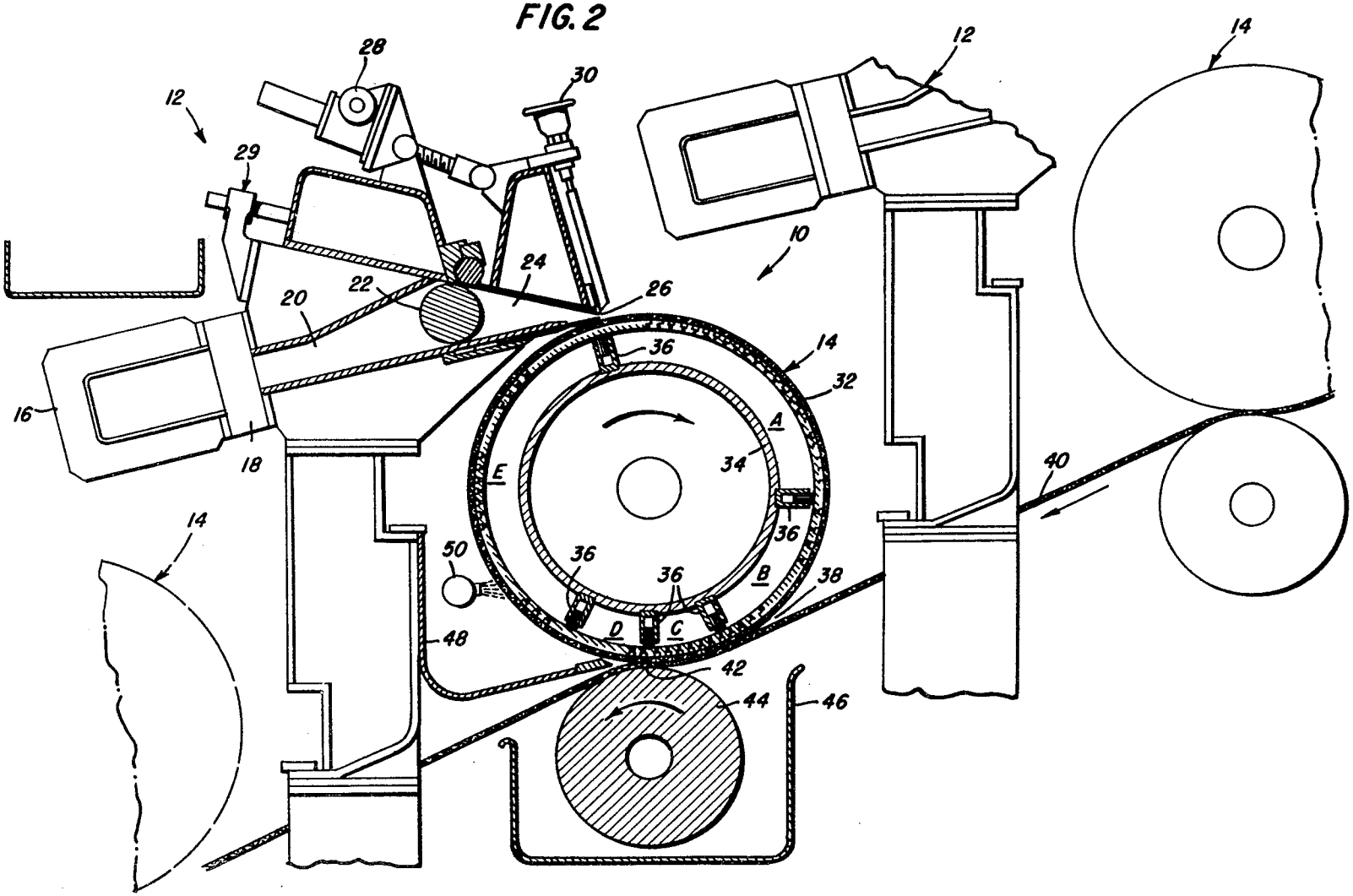

These together with other objects and other advantages will become apparent from a consideration of the following description when taken in conjunction with the drawing forming a part thereof, wherein;

FIG. 1 is a substantially diagrammatic, side elevational view of a plurality of cylinder-type forming machines showing the overall system and method; and FIG. 2 is an enlarged diagrammatic side elevational view showing details of one of the cylinder-type forming machines of FIG. 1.

Referring to the drawing in detail, and first considering FIG. 2, a forming machine is indicated generally at 10; the forming machine 10 includes a slurry feed assembly indicated generally at 12 and forming cylinder assembly indicated generally at 14.

The slurry feed assembly 12 includes a cross flow header 16 into which a pulp and water slurry is introduced, the slurry passing through a drilled plate 18 to be distributed across the face length of the cylinder. The slurry is dispersed and mixed in chamber 20 passing through a rectifier roll 22 at which the flow is deflocculated. Slurry flow acceleration is controlled at a converging slice nozzle 24 so that slurry emitted from the nozzle 24 will have a velocity approximately the same as that of the forming cylinder at the face of forming cylinder assembly 14. Adjustments of the slice opening 26 are accomplished in a conventional manner by control means 28, 29 and 30, for example.

The forming cylinder means 14 comprises a foraminous cylinder 32 supported for rotation on an axial tube 34 in any suitable manner to permit the cylinder to rotate about the tube. The forming cylinder has in its surface a plurality of water holding cells of a formation which is well-known and is covered by a wire mesh or the like, as is conventional, and will permit the drainage water from the slurry to freely flow toward the center of the cylinder as the cylinder 32 is rotated.

The slurry from the slice nozzle 24 will be deposited on the upper surface of the cylinder 32 and in close proximity thereto through slice opening 26. The cylinder 32 will be rotated in a clockwise direction and the slurry will be laid essentially tangentially on the surface of the cylinder (at the upper portion) and at a velocity approximately matching the surface speed of the rotating cylinder. This relationship is very comparable to the condition achieved at the slide and breast roll of a conventional Fourdrinier type paper producing machine.

To aid in the removal of excess slurry water and to offset effects of centrifugal force on the ply being formed, the tube 34 will have extending radially therefrom divider elements 36 forming a plurality of sector shaped vacuum chambers A, B, C, D, and E. The chambers A, B, and C will be in communication with the controlled vacuum to achieve the optimum condition for drainage, forming, holding and transfer of the ply deposited on the outer surface of the cylinder 32.

Transfer of the ply of paper or board occurs at the nip 38 formed between the cylinder 32 and a common porous or foraminous belt-like carrier in the form of a continuous transfer felt, wire or fabric 40. Transfer of the ply of paper or board into laminated relation with previously formed plies and bonding thereto is facilitated by application of pressure at nip 42 formed by a couch roll 44 engaged beneath the under-surface of the felt 40. The roll 44 is disposed in a catch pan 46 since an appreciable amount of excess water will be extracted or squeezed from the sheet at this point due to the pressure applied in the nip 42. Since some of the extracted water will be forced upward into the foraminous forming cylinder 32, i.e. at zone D, this area or chamber is subjected to a vacuum to insure that such excess water in the wire is carried away from the ply deposited on the felt 40 and passes beyond the couch roll 44. Zone E of the forming cylinder can be subjected to a positive pressure urging water off the forming cylinder 32 to be recovered in an underlying catch pan 48. Additionally, suitable washing nozzle means 50 may be provided to shower those portions of the cylinder 32 from which the ply has been removed, and, if necessary, additional cleaning and drying air can be provided in zone or chamber E, i.e. utilizing the discharge side of the vacuum pumps utilized to evacuate chambers A–D.

Considering FIG. 1, eight cylinder-type paper or board forming machines are suitably mounted on a support framework indicated generally at 52 and are disposed in vertically staggered relationship so that the head box of a preceding forming machine overlaps the forming machine downstream thereof, and in this manner minimizes the horizontal space occupied. The endless felt or wire 40, it will be noted, passes in a substantially single plane, i.e. its upper run, where the plies are removed from the forming cylinders 32. The bends and turns are minimized in the upper course of the felt or wire 40 and affords efficient transfer of the plies forming a continuous multiply web being produced. The felt 40 and its under or return course 41 is driven by a suitable motor or sectional drive connected to a driving roll 54. Additional helper type drives (not shown) may be applied to the forming cylinders 32 and/or couch rolls 44. Conventional means for maintaining belt tension, cleaning the belt etc. can be provided as indicated at 55, 56 and 57. The multi-ply, continuous web is removed at the downstream end 58 of the felt or belt 40.

Each of the forming machines 10 include means for adjusting the effective pressure applied by the couch roll 44, this means comprising pivotal support brackets 59 incorporating bearing 60 in which the support shaft of the couch roll 44 is journalled. The brackets 59 are adjustably pivoted at 62 and by means of a fluid motor 64 having a piston rod 66 are pivotally connected at 68 to the bracket 59.

Briefly, through the arrangement of the ply forming machines 10, as seen in FIG. 1, a layer of slurry can be laid down at an upper portion of each of the forming cylinders 32 and can be removed from a lower portion of the forming cylinders at nip 38 on the downward or inclined run of the felt 40. As will be observed from FIG. 2, the carrier 40 is intimately associated with the forming cylinder 32, beginning at 38 which is at least at or before the arc of the cylinder associated with the transfer zone and continuing about said forming cylinder until it traverses the couch roll pressure nip 42 which is so arranged that a radial line passing through the center of the forming cylinder and a divider element 36 at the pressure nip 42 will also pass through the center of the couch roll 44. As shown in FIG. 2, the combination of the carrier with the forming cylinder for the cylindrical surface length corresponding to the transfer zone is an area below the center of the forming cylinder in which the wet ply is below the wire mesh on the forming cylinder and above the carrier, and the upper surface of the wet ply is in contact with the wire mesh, and the lower surface of the wet ply is in contact with the carrier either directly, in the case of the first forming cylinder or indirectly, in the case of a subsequent forming cylinder. The couch rolls 44 insure integrated adherence of the fibers of the respective plies as they are deposited one upon the other, and the downward run will have a minimum change in its path of travel past each of the forming cylinders as an eight ply board or paper is produced on the disclosed installation. As previously mentioned, by merely minimizing the number of turns in the downward course of the felt 40, wear is minimized thus adding to the productive life of the installation. Further, through the use of this cylinder-type machine, an extremely high rate of production can be achieved. Still further, the overlapping staggered relationship of the respective machines in relation to an adjacent machine minimizes horizontal space occupied for an installation, as well as permitting the substantially single plane transfer felt 40 to be utilized.

The described apparatus and system afford a novel method for rapidly producing quality multi-ply, continuous web board or paper stock. The steps comprise continuously laying on an upper portion of a plurality of vertically staggered forming cylinders a layer of slurry in the direction the cylinders are being rotated and forming a single ply on each cylinder, subjecting each of the plies to a vacuum to dewater the deposited slurry, passing a transfer felt tangentially beneath each of the cylinders and in a substantially single plane and successively removing the ply from each cylinder as the felt passes therebeneath whereby the ply of each successive cylinder is juxtaposed onto the ply transferred from a preceding cylinder, and subjecting each ply, after it is transferred to the felt to pressure beneath said felt and against said cylinder and squeezing residual moisture out of the plies while urging juxtaposed plies into intimate mated relation while the plies are still wet.

Briefly, the system, apparatus and method produces multi-ply paper or paperboard in an inverted form, thus affording high production rates attained by cylinder-type formers and a quality product comparable to that of Fourdrinier type apparatus which has a slower rate of production.

The degree of dampness of the ply being continuously formed is controlled from slice opening 26 through the path of travel over chambers A–C so that when the ply is inverted onto felt 40 at nip 38 it is in an optimum condition. The vertical staggering of cylinders 32 permits the angular upper run of the transfer felt 40 to have rapid departure from the lower portion of the forming cylinder with the inverted ply thereon, i.e. the screen side of the ply will be facing upwardly.

The angular disposition of the upper run of the transfer felt forms a space whereby the catch pan 46 can be readily installed and readily catch liquids draining off the couch roll 44 and felt passing over the couch roll. Further, the angularly disposed, upper transfer felt run improves natural gravity drainage of this run as the felt passes over couch roll 44. Still further, since the transferred ply is still damp, and the screen side is facing upwardly, as another ply is deposited thereon, and the juxtaposed plies pass over the couch roll, water is, in a sense, forced into the underlying ply so that optimum ply bonding is attained.

All of the features mentioned lend themselves to continuous high speed production of quality stock as well as affording economic utilization of space required for installation of the apparatus.

Further, the cylinders are subjected to vacuum beyond the nip 42 for insuring that moisture forced into the cylinders 32 due to pressure applied at nip 42 will be carried away from the nip 42 and then be discharged into pan 48 whereafter the cylinder can be washed, dried, ect. in zone E prior to subsequent deposition of the slurry.

It will be obvious to those skilled in the art that various changes may be made without departing from the scope of the invention and that the invention is not to be considered limited to what is shown in the drawings and described in the specification.

What is claimed is:

1. A multi-cylinder paper making machine for producing a multi-ply continuous web of paper having ply-forming cylinders including the combination of (a) a multi-zoned wire mesh covered foraminous suction roll as at least one of said ply-forming cylinders.

(b) a continuous transfer ply carrier, and (c) couching means disposed beneath the center of said suction roll and engaging said carrier providing a pressure nip.

a plurality of chambers separated by circumferentially spaced and generally radial divider elements engaging the inner surface of said roll, and forming discrete zones associated with the outer surface of said roll through the foraminous roll structure which provides communication between the inner and outer roll surfaces, means for applying a film of paper component and water to an upper portion of said roll, vacuum means for application of vacuum to some of said zones and pressure means for application of pressure to one of said zones, a first zone to collect water from said film to form a wet ply, a second zone below the center of the roll and subsequent to said first zone to effect transfer of said wet ply by direct or indirect engagement with said carrier, said transfer being facilitated by the pressure nip provided by said couching means, the center of said roll, a divider element associated with said second zone, and said couching means pressure nip being in radial alignment, a transition third zone adjacent to said second zone for carrying excess water in the wire mesh after ply transfer away from said second zone to an adjacent fourth water release zone including said pressure means for urging water off the wire surface, said carrier being intimately associated with a lower portion of said roll and formed ply at least in the area along the complete arc of the roll corresponding to said transfer second zone, the association of said carrier with said roll beginning at, or before, the area along the complete arc corresponding to said transfer second zone, said association of said carrier with said roll continuing from its beginning at least at or before said transfer second zone to a place lying in a radial line drawn from the center of said roll generally downwardly through a divider element of said second zone and through the center of the pressure nip provided by said couching means whereby the combination of the carrier with the suction roll for the roll surface length of the second zone is an area below the center of said roll and in which the wet ply is below and between the wire mesh on the suction roll and above the carrier, and the upper surface of the wet ply is in contact with said wire mesh, and the lower surface of said wet ply is in direct or indirect contact with said carrier.

2. The combination set forth in claim 1, wherein said suction roll and said couching means which is in the form of a roll are supported for rotation with their respective axes extending generally horizontally and said continuous transfer ply carrier being arranged to move forwardly and downwardly in a direction inclined to both the horizontal and the vertical and first contacting said suction roll at least at or before the beginning of the arc in the area of said second zone, said carrier continuing in contact with said suction roll for the entire arc of said second zone to carry at least one formed ply in said area between the wire on said suction roll and the carrier so that one side of said formed ply is in contact with the wire and the other side of said ply is in direct or indirect contact with said carrier, said carrier being arranged to traverse said couch roll pressure nip and be in contact with the underside of said suction roll at a place within a radial line drawn from the center of the suction roll through a second zone divider element and the center of said couch roll;

a catch pan is secured in a position with a floor above said continuous transfer ply carrier downstream from said pressure nip said pan having at least a generally vertical wall from a part of which said floor portion extends rearwardly and upwardly at an incline toward said pressure nip and terminating just short of said continuous ply carrier and said suction roll without contact therewith.

* * * * *